US005454654A

United States Patent [19]

Bergström

[11] Patent Number: 5,454,654

[45] Date of Patent: Oct. 3, 1995

[54] PEN

[76] Inventor: Mårten Bergström, Östra Vallgatan 4, Lund, 223 61, Sweden

[21] Appl. No.: 284,492

[22] Filed: Aug. 2, 1994

[30] Foreign Application Priority Data

Feb. 3, 1992 [SE] Sweden ..... 9200288

[51] Int. Cl.[6] ..... B43K 7/12; B43K 29/00

[52] U.S. Cl. ..... 401/99; 401/131

[58] Field of Search ..... 401/131, 99

[56] References Cited

U.S. PATENT DOCUMENTS

| | | | |
|---|---|---|---|
| 29,917 | 1/1899 | Miller | 401/88 X |
| 1,122,909 | 12/1914 | Graff | 401/131 X |
| 4,037,975 | 7/1977 | Huffman | 401/6 |
| 4,306,818 | 12/1981 | Manusch | 401/6 |

FOREIGN PATENT DOCUMENTS

| | | | |
|---|---|---|---|
| 849588 | 11/1939 | France | 401/131 |
| 507393 | 12/1954 | Italy | 401/99 |
| 27926 | of 1908 | United Kingdom | 401/131 |
| 2164004 | 3/1986 | United Kingdom . | |

*Primary Examiner*—Steven A. Bratlie
*Attorney, Agent, or Firm*—Luedeka, Neely & Graham

[57] ABSTRACT

A pen having a holder (10) and a mechanism (11) arranged in the pen, comprises a substantially hemispherical writing end and has such a mass distribution that its centre of gravity is located between the crest of the writing end and the meridian plane of the substantially hemispherical writing end, such that the pen, when put e.g. on a table and having its nib (12) retracted, will automatically rise so as to stand substantially on the crest of the writing end when in its resting position.

5 Claims, 1 Drawing Sheet

PEN

Figures 1, 2, 3, 4:
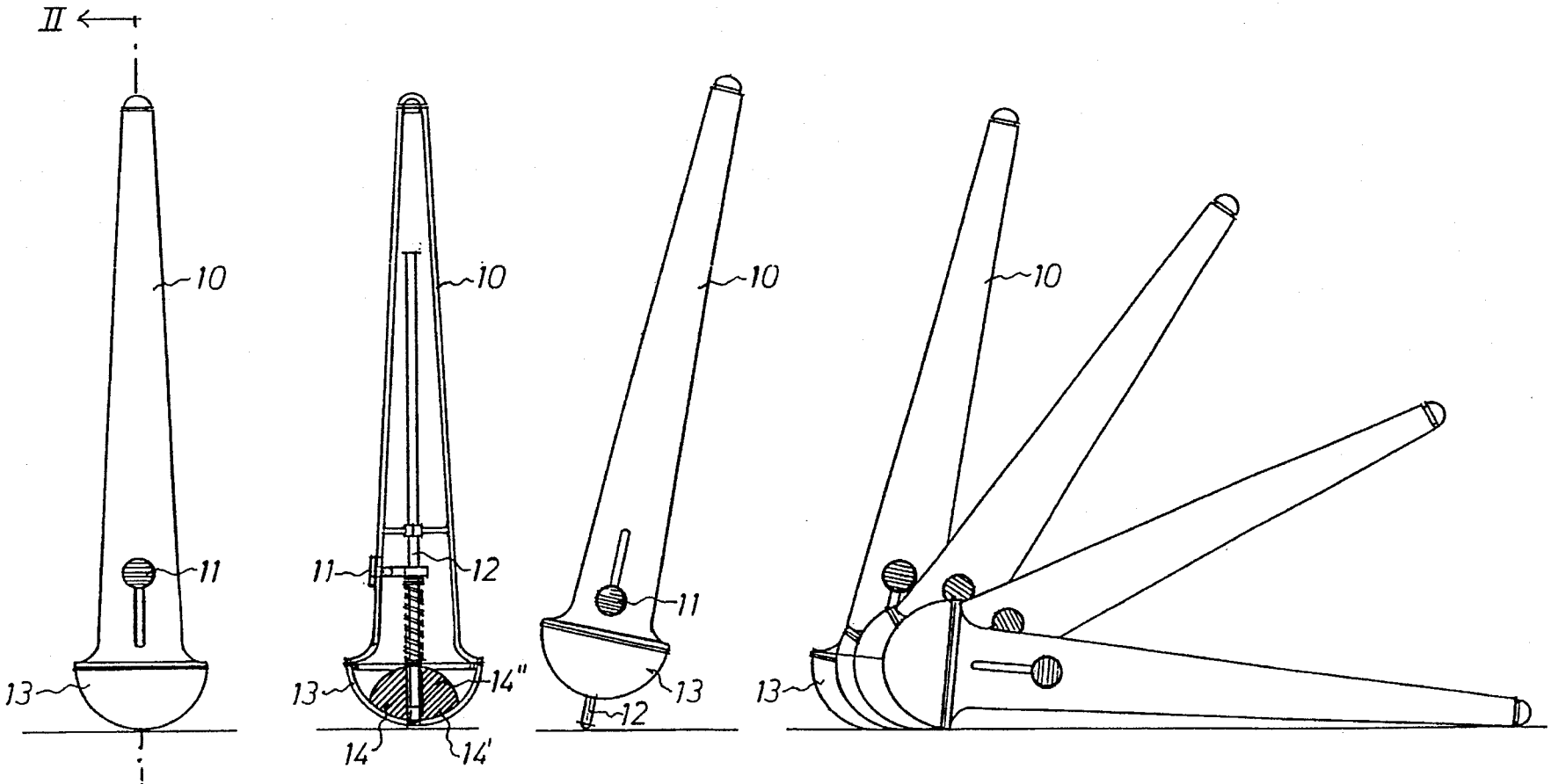

The present invention relates to a pen of the type having a mechanism for extending and retracting a nib at the writing end. Such pens are commonly used for advertising purposes, but may also be placed in-pen stands, e.g. on a reception desk. In the latter case, the pens have to be easily accessible as well easy to seize by the user. In a popular design, this is achieved by arranging a magnet in the penholder and then placing the pen in a separate stand in which a magnet is arranged in a projecting bracket, thereby using magnetic forces to make the pen stand up seemingly by itself. GB-A-2,164,004 teaches an instance of this technique.

The present invention aims at simplifying such prior-art pens while maintaining the desired function, i.e. providing a pen which, in resting position, stands up so as to be easy to seize as well as expose advertising text, if any. A special aim is to provide such a pen which is in no need of any separate, specially-designed stand.

The invention is based on the idea of designing the pen with a substantially hemispherical writing end and so locating the centre of gravity of the pen within the hemispherical writing end that the pen will occupy a stable resting position when erected.

Thus, an inventive pen has a holder and a mechanism contained in the pen. The writing end of the pen is substantially hemispherical. At the writing end, there is provided a weight of such mass that the center of gravity of the pen is located between the meridian plane of the substantially hemispherical writing end and the crest of the writing end, so that the pen, when put on e.g. a table and having its nib retracted, will automatically rise to an upright resting position.

The accompanying drawing illustrates an embodiment of the pen according to the invention. In the drawing, FIG. 1 shows the pen when standing in its resting position, FIG. 2 is a section taken along the line II—II in FIG. 1, FIG. 3 shows the pen in use with the nib extended, and FIG. 4 illustrates the rocking function of the pen when rising to the upright position (FIG. 1).

The embodiment of the inventive pen shown in the drawing has a holder 10 in which is arranged a mechanism 11. Although the illustrated mechanism is very simple, it will be appreciated that other and more complicated mechanisms may be used. The mechanism 11 adjusts the position of the nib 12, which may be either retracted (FIGS. 1, 2 and 4) or extended (FIG. 3).

As appears from the drawing, the writing end 13 of the pen is substantially hemispherical, and the nib 12 passes centrally through the writing end and is therefore positioned substantially at the centre of the crest of the writing end as well.

As can be seen from FIG. 2, a weight or body 14 is arranged within the hemispherical portion of the writing end 13 of the pen. This weight consists of a high-density material, such as iron or some other metal. The mass and the position of the weight should be such that the center of gravity of the pen will be located within the hemispherical portion of the writing end 13 of the pen, i.e. between the meridian plane of the hemispherical portion (approximately on a level with the joint between the holder 10 and the writing end 13) and the crest of the writing end (i.e. where the nib is extended and retracted). The farther away from the meridian plane and the closer to the crest of the writing end the centre of gravity is located, the better the aimed-at function of the pen is, i.e. the pen rises automatically to an upright resting position when put down.

If the penholder, the mechanism and the nib have a small mass, the weight can be in the form of a body 14 completely filling up the hemispherical writing end 13 of the pen, excepting the passage for the nib. In most cases, it is, however, much better to let the weight or body 14 fill up but the central parts of the writing end round the crest. In the embodiment shown, the weight or body 14 is substantially in the form of two coherent spherical calottes 14', 14" of different radius, the radius of the one calotte 14' being approximately of the same size as the radius of the hemispherical portion 13 of the writing end while the radius of the other calotte 14" is approximately half the size of the radius of the portion 13. As appears from FIG. 2, the larger-radius end or calotte 14' has been positioned in the area of the crest of the writing end. Owing to this design and position of the weight or body 14, the center of gravity can be displaced closer to the crest of the writing end, thereby improving the rising function of the pen. However, the weight or body 14 may be designed in many other ways, provided that the total center of gravity of the pen is positioned as required. In one alternative embodiment not illustrated in the drawing, the weight or body 14 is substantially in the form of a spherical sector whose spherical end then should be placed in the area of the crest of the writing end.

I claim:

1. A pen having a holder (10) and a mechanism (11) arranged in the pen and serving to retract and extend a nib (12) at the writing end (13) of the pen, characterised in that the writing end (13) of the pen is substantially hemispherical, is provided substantially at its crest with the extendible nib (12), and contains a weight (14) of such a mass that the center of gravity of the pen is located between the crest of the writing end and the meridian plane of the substantially hemispherical writing end, so that the pen will in itself occupy a stable upright resting position.

2. A pen as set forth in claim 1, characterised in that the distance between the center of gravity of the pen and the crest of the writing end (13) is shorter than the distance between the center of gravity of the pen and the meridian plane of the substantially hemispherical writing end.

3. A pen as set forth in claim 1, characterised in that the weight placed in the writing end (13) is in the form of a body (14) filling up only those parts of the substantially hemispherical writing end (13) that are closest to the crest of the writing end.

4. A pen as set forth in claim 3, characterised in that said weight (14) is substantially in the form of a spherical sector whose spherical end is located in the area of the crest of the writing end (13).

5. A pen as set forth in claim 3, characterised in that said weight (14) is substantially in the form of two coherent spherical calottes (14', 14") of different radius, the radius of the one calotte (14') being approximately of the same size as the radius of the hemispherical portion of the writing end (13) while the radius of the other calotte (14") is approximately half the size of the radius of the hemispherical portion of the writing end (13), and that the larger-radius end of the body (14) is located in the area of the crest of the writing end (13).

* * * * *

UNITED STATES PATENT AND TRADEMARK OFFICE

CERTIFICATE OF CORRECTION

PATENT NO. : 5,454,654
DATED : October 3, 1995
INVENTOR(S) : Mårten Bergström

It is certified that error appears in the above-indentified patent and that said Letters Patent is hereby corrected as shown below:

On the title page, left-hand column, below "[21] Appl. No. 284,492" and above "[30] Foreign Application Priority Data", please insert:

| | |
|---|---|
| -- [22] PCT Filed: | February 3, 1993 |
| [86] PCT No.: | PCT/SE93/00082 |
| § 371 Date: | Aug. 2, 1994 |
| § 102(e) Date: | Aug. 2, 1994 |
| [87] PCT Pub. No.: | WO93/14942 |
| PCT Pub. Date: | August 5, 1993 -- |

Signed and Sealed this
Eighth Day of October, 1996

Bruce Lehman

*Attest:*

BRUCE LEHMAN

*Attesting Officer*

*Commissioner of Patents and Trademarks*